US011804649B2

(12) United States Patent
Inomata et al.

(10) Patent No.: US 11,804,649 B2
(45) Date of Patent: Oct. 31, 2023

(54) ANTENNA SYSTEM FOR VEHICLE

(71) Applicants: AGC Inc., Tokyo (JP); NTT DOCOMO, INC., Tokyo (JP)

(72) Inventors: Minoru Inomata, Tokyo (JP); Tetsuro Imai, Tokyo (JP); Hideaki Shoji, Tokyo (JP); Shoichi Takeuchi, Tokyo (JP)

(73) Assignees: AGC INC., Tokyo (JP); NTT DOCOMO, INC., Tokyo (JP)

( * ) Notice: Subject to any disclaimer, the term of this patent is extended or adjusted under 35 U.S.C. 154(b) by 229 days.

(21) Appl. No.: 17/239,229

(22) Filed: Apr. 23, 2021

(65) Prior Publication Data

US 2021/0242578 A1 Aug. 5, 2021

Related U.S. Application Data

(63) Continuation of application No. PCT/JP2019/042136, filed on Oct. 28, 2019.

(30) Foreign Application Priority Data

Oct. 31, 2018 (JP) ..... 2018-206013

(51) Int. Cl.
*H01Q 1/32* (2006.01)
*H01Q 21/00* (2006.01)
*H01Q 21/28* (2006.01)

(52) U.S. Cl.
CPC ..... *H01Q 1/3233* (2013.01); *H01Q 21/0037* (2013.01); *H01Q 21/28* (2013.01)

(58) Field of Classification Search
CPC ... H01Q 21/0037; H01Q 1/3233; H01Q 21/28
See application file for complete search history.

(56) References Cited

U.S. PATENT DOCUMENTS 6,351,237 B1 2/2002 Martek et al.
10,186,763 B2 1/2019 Niihara et al.
(Continued)

FOREIGN PATENT DOCUMENTS

CN 1702911 A 11/2005
JP 2013-085058 A 5/2013
(Continued)

OTHER PUBLICATIONS

International Searching Authority, "International Search Report," issued in connection with International Patent Application No. PCT/JP2019/042136, dated Dec. 24, 2019.
(Continued)

*Primary Examiner* — Graham P Smith
(74) *Attorney, Agent, or Firm* — Foley & Lardner LLP

(57) ABSTRACT

An antenna system for a vehicle includes a plurality of antenna sets provided on or in proximity to a dielectric arranged on front and rear sides or on right and left sides of the vehicle, or arranged on both thereof, wherein a first antenna set includes first and second antennas, a second antenna set includes third and fourth antennas, a third antenna set includes fifth and sixth antennas, a fourth antenna set includes seventh and eighth antennas, each of the first, third, fifth, and seventh antennas has a higher antenna gain for transmitting and receiving a horizontally polarized wave than transmitting and receiving a vertically polarized wave, and each of the second, fourth, sixth, and eighth antennas has a higher antenna gain for transmitting and receiving the vertically polarized wave than transmitting and receiving the horizontally polarized wave.

20 Claims, 11 Drawing Sheets

(56) References Cited

U.S. PATENT DOCUMENTS

| | | | |
|---|---|---|---|
| 10,749,267 | B2 | 8/2020 | Sone |
| 2005/0264461 | A1 | 12/2005 | Sugimoto et al. |

FOREIGN PATENT DOCUMENTS

| | | | |
|---|---|---|---|
| WO | WO-2016/125876 | A1 | 8/2016 |
| WO | WO-2017/213243 | A1 | 12/2017 |

OTHER PUBLICATIONS

International Searching Authority, "Written Opinion," issued in connection with International Patent Application No. PCT/JP2019/042136, dated Dec. 24, 2019.

ANTENNA SYSTEM FOR VEHICLE

CROSS-REFERENCE TO RELATED APPLICATION

The present application is a continuation application filed under 35 U.S.C. 111 (a) claiming benefit under 35 U.S.C. 120 and 365 (c) of PCT International Application No. PCT/JP2019/042136 filed on Oct. 28, 2019 and designating the U.S., which claims priority to Japanese Patent Application No. 2018-206013 filed on Oct. 31, 2018. The entire contents of the foregoing applications are incorporated herein by reference.

BACKGROUND OF THE INVENTION

1. Field of the Invention

The present invention relates to an antenna system for a vehicle.

2. Description of the Related Art

In recent years, there is an ongoing trend of expansion of services using high-speed and large-capacity wireless communication systems communicating in microwave and millimeter wave frequency bands, one such example being a transition from 4G LTE (800 MHz band) to 5G (sub6). Specifically, the bandwidth used for such services tends to expand from the 3 GHz band to the 5 to 6 GHz band.

Furthermore, attempts have been made to spread wireless communication systems communicating in frequency bands higher than sub6 (for example, 28 GHz band, 40 GHz band, 60 GHz band, and 80 GHz band). Vehicle to Everything (V2X) such as vehicle-to-vehicle communication and vehicle-to-infrastructure communication is a known form of such wireless communications, and a vehicle equipped with such a wireless communication function is sometimes referred to as a connected car.

For such wireless communications, as an automotive antenna device used for LTE, there is an antenna device placed in a rear spoiler (see for example, PTL 1). Also, as an automotive antenna device used for V2X, there is a shark fin type antenna device placed on the roof (for example, see PTL 2).

CITATION LIST

Patent Literature

PTL 1: International Publication No. 2016/125876
PTL 2: International Publication No. 2017/213243

SUMMARY OF THE INVENTION

Technical Problem

However, the beamwidth of an antenna tends to get reduced when the antenna gain is increased. Therefore, it is difficult for a conventional single antenna placed at a single location on a vehicle to achieve both a higher antenna gain and a wider directivity. It is also difficult for the conventional single antenna device to support both horizontally polarized waves and vertically polarized waves with a higher antenna gain.

Accordingly, the present disclosure provides an antenna system that is for a vehicle and is capable of achieving both a higher antenna gain and a wider directivity with a lower polarization dependence.

Solution to Problem

The present disclosure provides an antenna system for a vehicle, including:

a plurality of antenna sets provided on or in proximity to a dielectric arranged on a front side and a rear side of the vehicle, or arranged on a right side and a left side of the vehicle, or arranged on both of the front side and the rear side of vehicle and the right side and the left side of the vehicle, wherein a first antenna set included in the plurality of antenna sets includes a first antenna and a second antenna, a second antenna set included in the plurality of antenna sets includes a third antenna and a fourth antenna, a third antenna set included in the plurality of antenna sets includes a fifth antenna and a sixth antenna, a fourth antenna set included in the plurality of antenna sets includes a seventh antenna and an eighth antenna, each of the first antenna, the third antenna, the fifth antenna, and the seventh antenna is a horizontal polarization antenna of which an antenna gain for transmitting and receiving a horizontally polarized wave is higher than an antenna gain for transmitting and receiving a vertically polarized wave, and each of the second antenna, the fourth antenna, the sixth antenna, and the eighth antenna is a vertical polarization antenna of which an antenna gain for transmitting and receiving the vertically polarized wave is higher than an antenna gain for transmitting and receiving the horizontally polarized wave.

Advantageous Effects of Invention

According to the technique of the present disclosure, an antenna system that is for a vehicle and is capable of achieving both a higher antenna gain and a wider directivity with a lower polarization dependence can be provided.

DETAILED DESCRIPTION OF THE PREFERRED EMBODIMENTS

Hereinafter, embodiments according to the present disclosure are described with reference to drawings. In each embodiment, deviations from directions such as a parallel direction, a perpendicular direction, an orthogonal direction, a horizontal direction, a vertical direction, a height direction, a width direction, and the like are tolerated so long as the effects of the present invention are not impaired. Further, an X axis direction, a Y axis direction, and a Z axis direction represent a direction parallel to the X axis, a direction parallel to the Y axis, and a direction parallel to the Z axis, respectively. The X axis direction, the Y axis direction, and the Z axis direction are orthogonal to each other. The XY plane, the YZ plane, and the ZX plane are a virtual plane parallel to the X axis direction and the Y axis direction, a virtual plane parallel to the Y axis direction and the Z axis direction, and a virtual plane parallel to the Z axis direction and the X axis direction, respectively.

An antenna system for a vehicle according to the present disclosure transmits and receives electromagnetic waves in high frequency bands such as microwave and millimeter waves (for example, an SHF (Super High Frequency) band at 3 to 30 GHz and an EHF (Extremely High Frequency) band at 30 to 300 GHz). For example, the antenna system for the vehicle according to the present disclosure can be applied to V2X communication systems, the fifth generation mobile communication system (generally referred to as 5G), automotive radar systems, and the like, but the applicable systems are not limited thereto.

Figure 1:
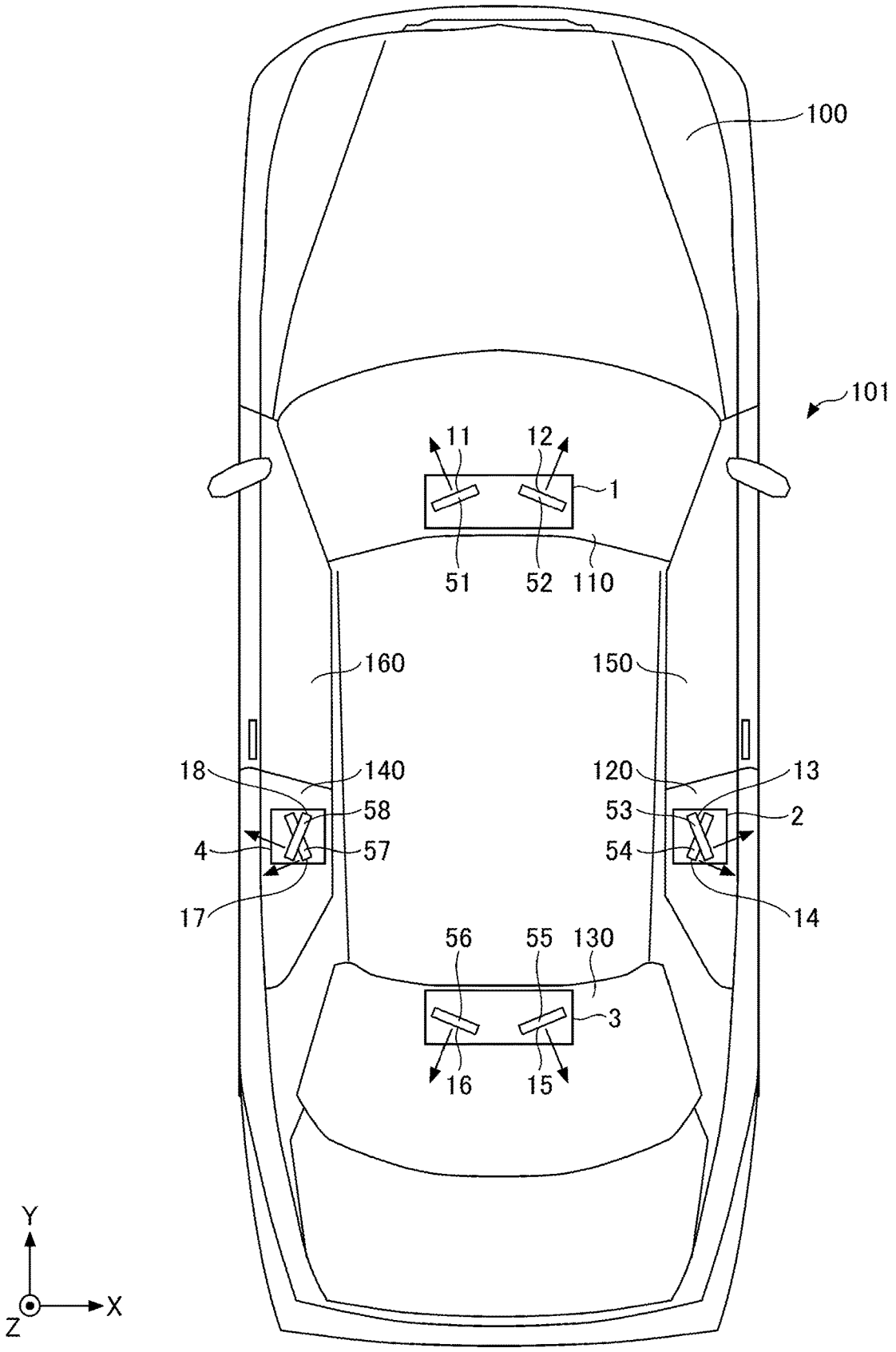
FIG. 1 is a drawing illustrating, in a plan view, an example of a vehicle provided with an antenna system for the vehicle.
Figure 2:
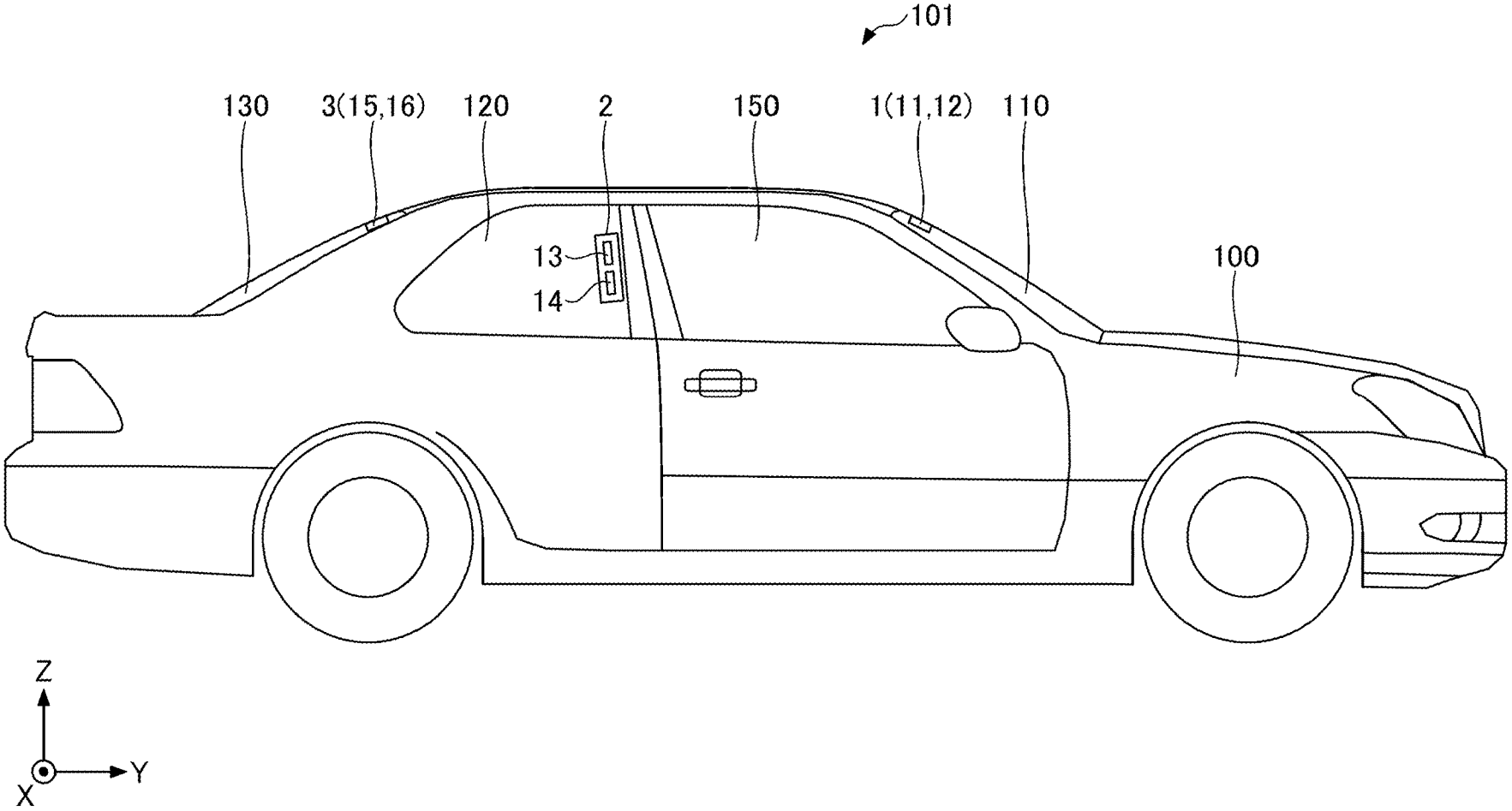
FIG. 2 is a drawing illustrating, in a side view, the example of the vehicle provided with the antenna system for the vehicle.

FIG. 1 is a drawing illustrating, in a plan view, an example of a vehicle provided with the antenna system for the vehicle according to an embodiment of the present disclosure. FIG. 2 is a drawing illustrating, in a side view, the example of the vehicle provided with the antenna system for the vehicle according to the embodiment of the present disclosure. An antenna system 101 illustrated in FIGS. 1 and 2 is an example of an antenna system for a vehicle 100 including a plurality of antenna sets provided on or in proximity to a dielectric arranged on a front side and a rear side of the vehicle 100, or arranged on a right side and a left side of the vehicle 100, or arranged on both of the front side and the rear side of vehicle 100 and the right side and the left side of the vehicle 100.

In each drawing, the X axis direction corresponds to the vehicle width direction of the vehicle 100, the Y axis direction corresponds to the longitudinal direction of the vehicle 100, and the Z axis direction corresponds to the height direction of the vehicle 100. An XY plane corresponds to the horizontal plane, and the Z axis direction corresponds to a direction (i.e., the vertical direction) perpendicular to the horizontal plane.

FIGS. 1 and 2 illustrate an example of a plurality of antenna sets arranged in proximity to window glass arranged on a front side and a rear side of the vehicle 100, or arranged on a right side and a left side of the vehicle 100, or arranged on both of the front side and the rear side of vehicle 100 and the right side and the left side of the vehicle 100. A first antenna set 1 is arranged in proximity to a windshield 110, i.e., a dielectric arranged on the front side of the vehicle 100, and is more specifically arranged in proximity to the upper central portion on the inner side, i.e., the passenger compartment side, of the windshield 110. A second antenna set 2 is arranged in proximity to right-side fixed window glass 120, i.e., a dielectric on the right side of the vehicle 100, and is more specifically arranged in proximity to a front-side end portion on the inner side, i.e., the passenger compartment side, of the right-side fixed window glass 120. A third antenna set 3 is arranged in proximity to a rear glass 130, i.e., a dielectric on the rear side of the vehicle 100, and is more specifically arranged in proximity to the upper central portion on the inner side, i.e., the passenger compartment side, of the rear glass 130. A fourth antenna set 4 is arranged in proximity to left-side fixed window glass 140, i.e., a dielectric on the left side of the vehicle 100, and is more specifically arranged in proximity to a front-side end portion on the inner side, i.e., the passenger compartment side, of the left-side fixed window glass 140.

For example, each antenna set is configured to be able to transmit and receive electromagnetic waves of a predetermined frequency included in a range of 3 GHz or more and 100 GHz or less.

The first antenna set 1 includes a first antenna 11 and a second antenna 12, and the second antenna set 2 includes a third antenna 13 and a fourth antenna 14. The third antenna set 3 includes a fifth antenna 15 and a sixth antenna 16, and the fourth antenna set 4 includes a seventh antenna 17 and an eighth antenna 18. Each of the first antenna 11, the third antenna 13, the fifth antenna 15, and the seventh antenna 17 is a horizontal polarization antenna of which an antenna gain for transmitting and receiving a horizontally polarized wave is higher than an antenna gain for transmitting and receiving a vertically polarized wave. Each of the second antenna 12, the fourth antenna 14, the sixth antenna 16, and the eighth antenna 18 is a vertical polarization antenna of which an antenna gain for transmitting and receiving the vertically polarized wave is higher than an antenna gain for transmitting and receiving the horizontally polarized wave.

Where, at a predetermined frequency, the antenna gain of the horizontal polarization antenna for the horizontally polarized wave is denoted as $G_H$ [dBi] and the antenna gain of the horizontal polarization antenna for the vertically polarized wave is denoted as $G_V$ [dBi], $G_H$–$G_V$ may be equal to or more than 10 [dB], and is more preferably equal to or more than 15 [dB]. A cross polarization discrimination of the horizontal polarization antenna with respect to the vertical polarization antenna may be equal to or more than 10 [dB] and is more preferably equal to or more than 15 [dB].

Where, at the predetermined frequency, the antenna gain of the vertical polarization antenna for the vertically polarized wave is denoted as $G_V$ [dBi] and the antenna gain of the vertical polarization antenna for the horizontally polarized wave is denoted as $G_H$ [dBi], $G_V$–$G_H$ may be equal to or more than 10 [dB], and is more preferably equal to or more than 15 [dB]. A cross polarization discrimination of the vertical polarization antenna with respect to the horizontal polarization antenna may be equal to or more than 10 [dB] and is more preferably equal to or more than 15 [dB].

In the antenna system 101, the four antenna sets 1, 2, 3, and 4 are arranged in a distributed manner at the front, rear, left, and right of the vehicle 100. Therefore, even when the antenna gain of one or a plurality of antenna sets from among the antenna sets 1, 2, 3, and 4 is increased and accordingly the beamwidth of the one or plurality of antenna sets decreases, the beamwidths of the remaining antenna sets can cover a reduction in the antenna gain in directions other than the beam direction caused by the reduced beamwidth. Therefore, the antenna system 101 can achieve both a higher antenna gain and a wider directivity than a single antenna placed at a single location on the vehicle. The beamwidth referred to herein may be considered to be, for example, a half-power beam angle of the main beam.

Each of the antenna sets 1, 2, 3, and 4 has both a horizontal polarization antenna and a vertical polarization antenna. Therefore, the antenna system 101 can support both the horizontally polarized waves and the vertically polarized waves, so that the polarization dependence can be reduced.

In this manner, according to the present embodiment, the antenna system that is for the vehicle and is capable of achieving both a higher antenna gain and a wider directivity and capable of achieving the effect of reducing the polarization dependence can be provided. According to such effects, for example, even in a NLOS (Non Line Of Sight) environment where a direct wave does not exist, the stability of the communication can be ensured, and the reception sensitivity for multipath electromagnetic waves can be improved.

As illustrated in FIG. 1, in order to achieve both a higher antenna gain and a wider directivity and reduce the polarization dependence, the first antenna 11 and the second antenna 12 are preferably arranged so that the directions of the main beams of the first antenna 11 and the second antenna 12 are different from each other. Also, for example, in a case where the first antenna 11 is provided on a first substrate 51, and the second antenna 12 is provided on a second substrate 52, the first substrate 51 and the second substrate 52 are preferably arranged so that the directions normal to the antenna surfaces are different from each other. In a case of a "planar antenna" such as a patch antenna explained later, the "antenna surface" means the plane (more specifically, a substrate surface) of the planar antenna.

The direction of the main beam (also referred to as a main lobe) indicates a direction in which the highest antenna gain is measured (a maximum gain direction) with respect to any given reference point (for example, a position where the antenna set is arranged) of the vehicle.

Likewise, as illustrated in FIG. 1, in order to achieve both a higher antenna gain and a wider directivity and reduce the polarization dependence, the third antenna 13 and the fourth antenna 14 are preferably arranged so that the directions of the main beams of the third antenna 13 and the fourth antenna 14 are different from each other. For example, in a case where the third antenna 13 is provided on a third substrate 53, and a fourth antenna 14 is provided on a fourth substrate 54, the third substrate 53 and the fourth substrate 54 are preferably arranged so that directions normal to the antenna surfaces are different from each other.

Likewise, as illustrated in FIG. 1, in order to achieve both a higher antenna gain and a wider directivity and reduce the polarization dependence, the fifth antenna 15 and the sixth antenna 16 are preferably arranged so that the directions of the main beams of the fifth antenna 15 and the sixth antenna 16 are different from each other. For example, in a case where the fifth antenna 15 is provided on a fifth substrate 55, and the sixth antenna 16 is provided on a sixth substrate 56, the fifth substrate 55 and the sixth substrate 56 are preferably arranged so that directions normal to the antenna surfaces are different from each other.

Likewise, as illustrated in FIG. 1, in order to achieve both a higher antenna gain and a wider directivity and reduce the polarization dependence, the seventh antenna 17 and the eighth antenna 18 are preferably arranged so that the directions of the main beams of the seventh antenna 17 and the eighth antenna 18 are different from each other. For example, in a case where the seventh antenna 17 is provided on a seventh substrate 57, and the eighth antenna 18 is provided on an eighth substrate 58, the seventh substrate 57 and the eighth substrate 58 are preferably arranged so that directions normal to the antenna surfaces are different from each other.

The antennas 11 to 18 or the substrates 51 to 58 are arranged in this manner, so that the directivity of the antenna system 101 in the horizontal plane with respect to the vehicle 100 can be brought closer to an omnidirectional pattern. The reception sensitivities for both of the horizontally polarized waves and the vertically polarized waves coming from all the directions in the azimuth plane can be improved (i.e., the polarization-insensitivity can be improved).

The antennas 11 to 18 are more preferably arranged so that the directions of the main beams of the antennas 11 to 18 are all different from each other. For example, when the vehicle 100 is seen from above, the substrates 51 to 58 are more preferably arranged so that the directions normal to the antenna surfaces of the substrates 51 to 58 are all different from each other.

Figure 3:
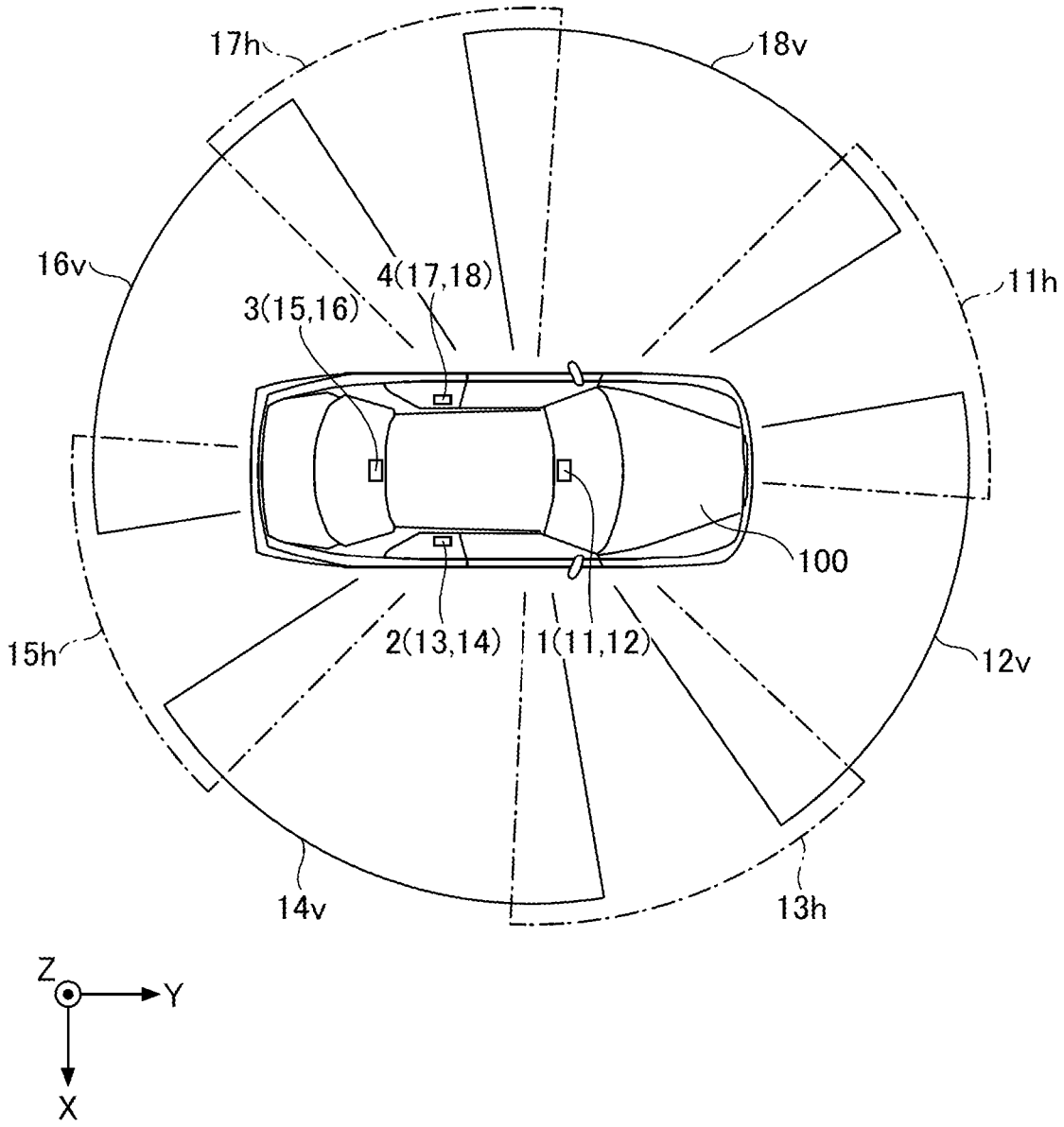
FIG. 3 is a drawing illustrating an example of directivity of each antenna as seen from above the vehicle.

FIG. 3 indicates that, when the vehicle 100 is seen from above, the direction of the main beam of the antennas 11 to 18 are all different. Reference numerals 11*h*, 12*v*, 13*h*, 14*v*, 15*h*, 16*v*, 17*h*, and 18*v* denote half-power beam angles of the main beams formed by the antennas 11 to 18, respectively, when the vehicle 100 is seen from above. In other words, in FIG. 3, when the vehicle 100 is seen from above, the directions of the main beams formed by the antennas 11 to 18 correspond to the centers of the respective half-power beam angles.

In this manner, when the vehicle 100 is seen from above, the directions of the main beams of the antennas 11 to 18 are all different, the directivity of the antenna system 101 with respect to the vehicle 100 can be further brought closer to the omnidirectional pattern. The reception sensitivities for both of the horizontally polarized waves and the vertically polarized waves coming from all the directions in the azimuth plane can be further improved. In the respective antennas, the directions normal to the substrates 51 to 58 may be configured to be all different from each other.

FIG. 3 indicates that the directions of the main beams of the antennas 11, 13, 15, and 17 for the horizontally polarized waves and the directions of the main beams of the antennas 12, 14, 16, and 18 for the vertically polarized waves are alternately arranged in a clockwise direction when the vehicle 100 is seen from above. The antennas 11 to 18 are arranged so that the directions of the main beams of the antennas 11 to 18 for the horizontally polarized waves and the vertically polarized waves are alternately arranged in a clockwise direction in this manner, so that the directivity of the antenna system 101 in the horizontal plane with respect to the vehicle 100 can be further brought closer to the omnidirectional pattern. In addition, the reception sensitivities for both of the horizontally polarized waves and the vertically polarized waves coming from all the directions in the azimuth plane can be further improved.

An angle famed by the direction of the main beam of the first antenna 11 and the direction of the main beam of the second antenna 12 is denoted as $\theta_{12}$. The angle $\theta_{12}$ is preferably equal to or more than 90 degrees and is less than 180 degrees. More preferably, the angle $\theta_{12}$ is equal to or more than 100 degrees and is equal to or less than 170 degrees. Still more preferably, the angle $\theta_{12}$ is equal to or more than 110 degrees and is equal to or less than 160 degrees. For example, in a case where the substrate surface and the antenna surface are arranged parallel to each other in any given antenna, an angle formed by the first substrate 51 and the second substrate 52 is denoted as $\gamma_{12}$. Likewise, in the respective antennas, an angle $\gamma_{34}$, an angle $\gamma_{56}$, and an angle $\gamma_{78}$ explained later denote such an angle in a case where the substrate surface and the antenna surface are parallel to each other. The angle $\gamma_{12}$ is preferably equal to or more than 90 degrees and is less than 180 degrees. More preferably, the angle $\gamma_{12}$ is equal to or more than 100 degrees and is equal to or less than 170 degrees. Still more preferably, the angle $\gamma_{12}$ is equal to or more than 110 degrees and is equal to or less than 160 degrees. When the angle $\theta_{12}$ or the angle $\gamma_{12}$ are set in such an angular range, the directivity of the antenna system 101 can be brought closer to the omnidirectional pattern, and the reception sensitivities for both of the horizontally polarized waves and the vertically polarized waves can be improved.

Due to similar reasons, an angle $\theta_{34}$ formed by the direction of the main beam of the third antenna 13 and the direction of the main beam of the fourth antenna 14 is preferably in an angular range similar to the angle $\theta_{12}$. An angle $\theta_{56}$ formed by the direction of the main beam of the fifth antenna 15 and the direction of the main beam of the sixth antenna 16 is also similarly configured. An angle $\theta_{78}$ formed by the direction of the main beam of the seventh antenna 17 and the direction of the main beam of the eighth antenna 18 is also similarly configured.

Due to similar reasons, an angle $\gamma_{34}$ formed by the third substrate 53 and the fourth substrate 54 is preferably in an angular range similar to the angle $\gamma_{12}$. Further, an angle $\gamma_{56}$ formed by the fifth substrate 55 and the sixth substrate 56 and an angle $\gamma_{78}$ famed by the seventh substrate 57 and the eighth substrate 58 are also similarly configured.

The antennas 11 to 18 may be arranged so that an elevation angle $\alpha$ in each of the directions of the main beams of the antennas 11 to 18 is equal to or more than 0 degrees and is equal to or less than 60 degrees, and are preferably arranged so that the elevation angle $\alpha$ in each of the directions of the main beams of the antennas 11 to 18 is equal to or more than 10 degrees and is equal to or less than 60 degrees. For example, in the respective antennas, the substrates 51 to 58 may be arranged so that an elevation angle $\beta$ in each of the directions normal to the substrates 51 to 58 is equal to or more than 0 degrees and is equal to or less than 60 degrees, and are preferably arranged so that the elevation angle $\beta$ in each of the directions normal to the substrates 51 to 58 is equal to or more than 10 degrees and is equal to or less than 60 degrees. In other words, in this case, the elevation angle $\alpha$ is equal to the elevation angle $\beta$.

Figure 4:
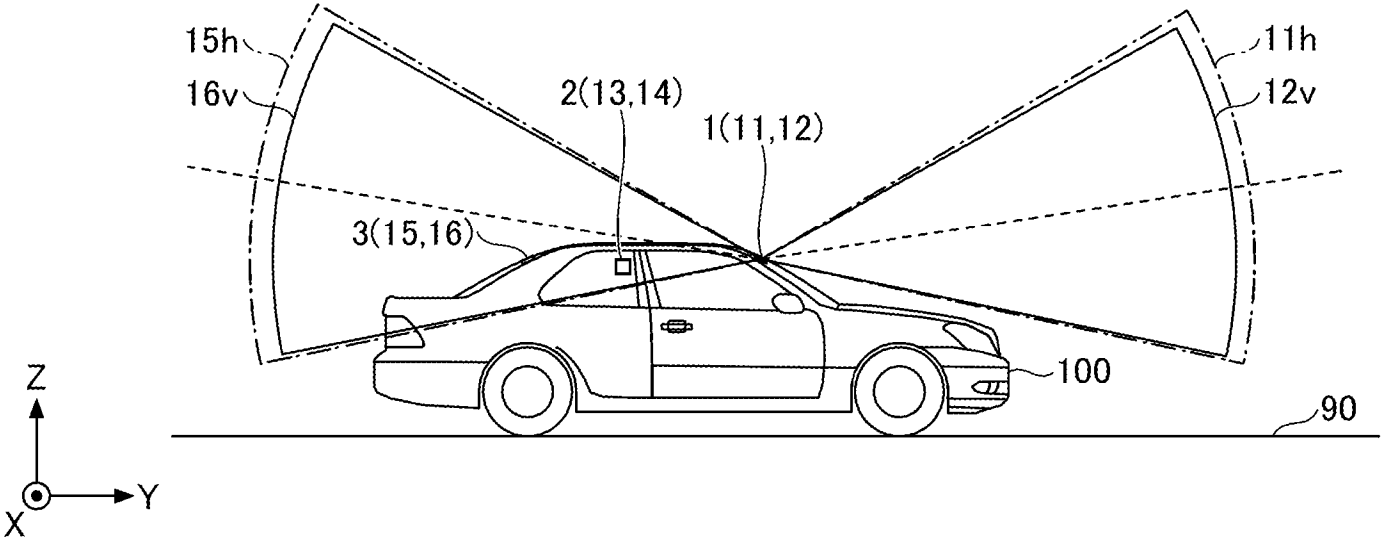
FIG. 4 is a drawing illustrating an example of directivity of each antenna in a vertical plane.

FIG. 4 is a drawing illustrating the elevation angle $\alpha$ or the elevation angle $\beta$. The elevation angle $\alpha$ or the elevation angle $\beta$ represents an angle formed with respect to a horizontal plane 90, and a broken line in FIG. 4 indicates the direction of the main beam.

Therefore, for example, when the elevation angle $\alpha$ or the elevation angle $\beta$ is configured to be in an angular range of equal to or more than 10 degrees and equal to or less than 60 degrees, the reception sensitivities for both of the horizontally polarized waves and the vertically polarized waves coming from higher directions with respect to the vehicle 100 can be improved.

The first antenna set 1 is arranged on or in proximity to the windshield 110, i.e., an example of the dielectric arranged on the front side of the vehicle 100. In this case, the arrangement of (i.e., the direction for arranging) the first antenna 11 and the second antenna 12 is not particularly limited, but the first antenna 11 and the second antenna 12 are preferably arranged next to each other in the horizontal direction (i.e., in the X axis direction in the case of FIG. 1) so that, when the vehicle 100 is seen from above, the directions of the main beams of the first antenna 11 and the second antenna 12 extend toward the area in front of the vehicle 100 as illustrated in FIG. 3. The first antenna 11 and the second antenna 12 are arranged next to each other in the horizontal direction, so that obstruction of the view through the windshield 110 is likely to be alleviated, as compared with the case where the first antenna 11 and the second antenna 12 are arranged next to each other in a direction perpendicular to the horizontal plane. For example, as illustrated in FIG. 1, in order to alleviate obstruction of the view through the windshield 110, the first substrate 51 and the second substrate 52 are preferably arranged next to each other in the horizontal direction so as to face the area in front of the vehicle 100. Note that, in a case where the first antenna set 1 is provided on the windshield 110, obstruction of the view through the windshield 110 is likely to be alleviated, for example, when the first antenna set 1 overlaps with at least a portion of or the entirety of a shielding film (not illustrated) of the periphery of the windshield 110, or when the first antenna set 1 is provided between the windshield 110 and a rear view mirror. Specific examples of the shielding layer include ceramics such as a black ceramic film and the like.

The third antenna set 3 is arranged on or in proximity to the rear glass 130, i.e., an example of a dielectric arranged on a rear side of the vehicle 100. In this case, the arrangement of (i.e., the direction for arranging) the fifth antenna 15 and the sixth antenna 16 is not particularly limited, but the fifth antenna 15 and the sixth antenna 16 are preferably arranged next to each other in the horizontal direction (i.e., in the X axis direction in the case of FIG. 1) so that, when the vehicle 100 is seen from above, the directions of the main beams of the fifth antenna 15 and the sixth antenna 16 extend toward an area behind the vehicle 100 as illustrated in FIG. 3. The fifth antenna 15 and the sixth antenna 16 are arranged next to each other in the horizontal direction, so that obstruction of the view through the rear glass 130 is likely to be alleviated, as compared with the case where the fifth antenna 15 and the sixth antenna 16 are arranged next to each other in a direction perpendicular to the horizontal plane. For example, as illustrated in FIG. 1, in order to alleviate obstruction of the view through the rear glass 130, the fifth substrate 55 and the sixth substrate 56 are preferably arranged next to each other in the horizontal direction so as to face the area behind the vehicle 100. Note that, in a case where the third antenna set 3 is provided on the rear glass 130, obstruction of the view through the rear glass 130 is likely to be alleviated, for example, when the third antenna set 3 overlaps with at least a portion of or the entirety of a shielding film (not illustrated) of the periphery of the rear glass 130.

The second antenna set 2 is arranged on or in proximity to right-side fixed window glass 120, i.e., an example of a dielectric arranged on a right side of the vehicle 100. In this case, the arrangement of (i.e., the direction for arranging) of the third antenna 13 and the fourth antenna 14 is not particularly limited, but the third antenna 13 and the fourth antenna 14 are preferably arranged next to each other in a direction perpendicular to the horizontal plane (i.e., the vertical direction, that is the Z axis direction in the case of FIGS. 1 and 2) so that, when the vehicle 100 is seen from above, the directions of the main beams of the third antenna 13 and the fourth antenna 14 extend toward the area to the right of the vehicle 100 as illustrated in FIG. 3. The third antenna 13 and the fourth antenna 14 are arranged next to each other in the vertical direction, so that obstruction of the view through the right-side fixed window glass 120 is likely to be alleviated, as compared with the case where the third antenna 13 and the fourth antenna 14 are arranged next to each other in the horizontal direction. This is because the length of the right-side fixed window glass 120 in the horizontal direction is shorter than other window glasses such as the windshield 110. For example, as illustrated in FIG. 1, in order to alleviate obstruction of the view through the right-side fixed window glass 120, the third substrate 53 and the fourth substrate 54 are preferably arranged next to each other in the vertical direction so as to face the area to the right of the vehicle 100. Note that, in a case where the second antenna set 2 is provided on the right-side fixed window glass 120, obstruction of the view through the right-side fixed window glass 120 is likely to be alleviated, for example, when the second antenna set 2 overlaps with at least a portion of or the entirety of a shielding film (not illustrated) of the periphery of the right-side fixed window glass 120. In a case where there is a resin frame as a dielectric around the right-side fixed window glass 120, the second antenna set 2 may overlap with a portion of or the entirety of the resin frame to such a degree that a predetermined antenna gain is obtained. In this manner, obstruction of the view through the right-side fixed window glass 120 is likely to be alleviated.

The fourth antenna set 4 is arranged on or in proximity to the left-side fixed window glass 140, i.e., an example of a dielectric arranged on a left side of the vehicle 100. In this case, the arrangement of (i.e., the direction for arranging) the seventh antenna 17 and the eighth antenna 18 is not particularly limited, but the seventh antenna 17 and the eighth antenna 18 are preferably arranged next to each other in a direction perpendicular to the horizontal plane (i.e., the vertical direction, that is the Z axis direction in the case of FIGS. 1 and 2) so that, when the vehicle 100 is seen from above, the directions of the main beams of the seventh antenna 17 and the eighth antenna 18 extend toward the area to the left of the vehicle 100 as illustrated in FIG. 3. The seventh antenna 17 and the eighth antenna 18 are arranged next to each other in the vertical direction, so that obstruction of the view through the left-side fixed window glass 140 is likely to be alleviated, as compared with the case where the seventh antenna 17 and the eighth antenna 18 are arranged next to each other in the horizontal direction. This is because the length of the left-side fixed window glass 140 in the horizontal direction is shorter than other window glasses such as the windshield 110. For example, as illustrated in FIG. 1, in order to alleviate obstruction of the view through the left-side fixed window glass 140, the seventh substrate 57 and the eighth substrate 58 are preferably arranged next to each other in the vertical direction so as to face the area to the left of the vehicle 100. Note that, in a case where the fourth antenna set 4 is provided on the left-side fixed window glass 140, obstruction of the view through the left-side fixed window glass 140 is likely to be alleviated, for example, when the fourth antenna set 4 overlaps with at least a portion of or the entirety of a shielding film (not illustrated) of the periphery of the left-side fixed window glass 140. In a case where there is a resin frame as a dielectric around the left-side fixed window glass 140, the fourth antenna set 4 may overlap with a portion of or the entirety of the resin frame to such a degree that a predetermined antenna gain is obtained. In this manner, obstruction of the view through the left-side fixed window glass 140 is likely to be alleviated.

When the vehicle 100 is seen from above, the third antenna 13 and the fourth antenna 14 arranged next to each other in the vertical direction are preferably arranged so as to cross each other, and the seventh antenna 17 and the eighth antenna 18 arranged next to each other in the vertical direction are preferably arranged so as to cross each other. In this manner, with such an arrangement to cross each other, the external dimensions of each of the second antenna set 2 and the fourth antenna set 4 in the horizontal direction can be reduced. For example, as illustrated in FIG. 1, in order to reduce the external dimensions of the second antenna set 2 in the horizontal direction, the third substrate 53 and the fourth substrate 54 arranged next to each other in the vertical direction are preferably arranged so as to cross each other when the vehicle 100 is seen from above. Likewise, in order to reduce the external dimensions of the fourth antenna set 4 in the horizontal direction, the seventh substrate 57 and the eighth substrate 58 arranged next to each other in the vertical direction are preferably arranged so as to cross each other when the vehicle 100 is seen from above.

The antenna gain of each of the main beams of the antennas 11 to 18 is preferably equal to or more than 4 dBi and is equal to or less than 11 dBi. More preferably, the antenna gain of each of the main beams of the antennas 11 to 18 is equal to or more than 5 dBi and is equal to or less than 10 dBi. Still more preferably, the antenna gain of each of the main beams of the antennas 11 to 18 is equal to or more than 6 dBi and is equal to or less than 9 dBi. When the antenna gain of the main beam is configured to be equal to or more than 4 dBi and equal to or less than 11 dBi, the half-power beam angle of the main beam becomes equal to or more than approximately 40 degrees and equal to or less than approximately 90 degrees. Therefore, for horizontally polarized waves, both a higher antenna gain and a wider directivity can be achieved by distributing and arranging, at four positions, the antennas 11, 13, 15, and 17 for the horizontally polarized waves of which the antenna gains have been adjusted to such ranges. Likewise, for vertically polarized waves, both a higher antenna gain and a wider directivity can be achieved by distributing and arranging, at four positions, the antennas 12, 14, 16, and 18 for the vertically polarized waves of which the antenna gains have been adjusted to such ranges.

Where a wavelength of an electromagnetic wave transmitted and received is denoted as λ, a distance between any given two of the antennas 11, 13, 15, and 17 for the horizontally polarized waves is preferably 10λ or more, more preferably 15λ or more, and still more preferably 20λ or more. Likewise, a distance between any given two of the antennas 12, 14, 16, and 18 for the vertically polarized waves is preferably 10λ or more, more preferably 15λ or more, and still more preferably 20λ or more. The upper limit value of the distance changes according to the size of the vehicle on which the antennas are provided. When the distance between any given two of the antennas for the same polarization is 10λ or more, the correlation coefficient between antennas significantly decreases as compared to when the distance is less than 10λ, and therefore, the antennas can be suitably used as MIMO (Multiple Input Multiple Output) antennas. For example, in a case of an electromagnetic wave with a frequency of 28 GHz, 10λ is approximately 100 mm.

Figure 5:
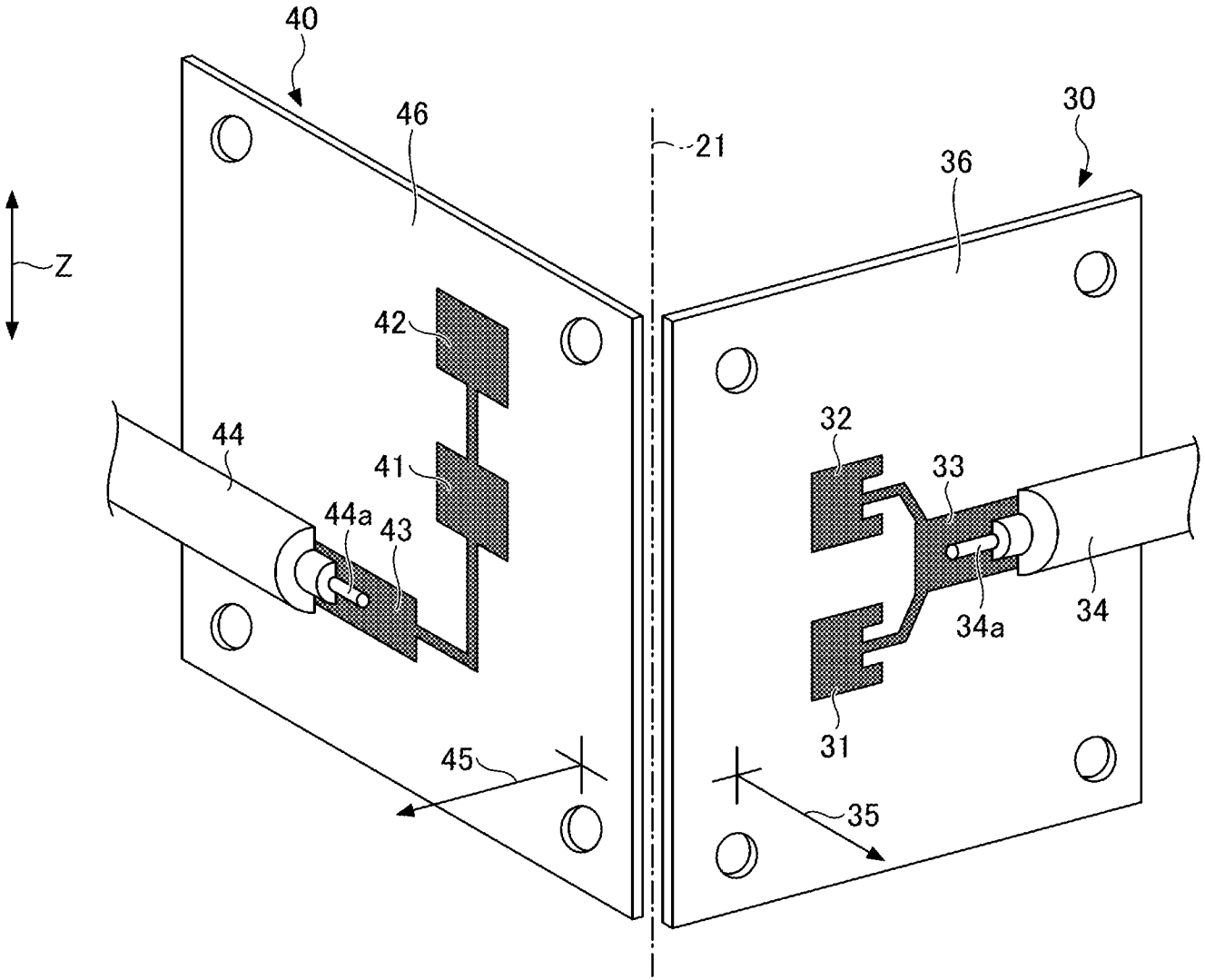
FIG. 5 is a drawing illustrating an example of an antenna set including two antennas arranged in the horizontal direction.

FIG. 5 is a drawing illustrating an example of an antenna set including a horizontal polarization antenna 30 and a vertical polarization antenna 40 arranged next to each other in the horizontal direction. The antenna set as illustrated in FIG. 5 is, for example, an example of the first antenna set 1 and the third antenna set 3 explained above. In the case of the first antenna set 1, the horizontal polarization antenna 30 corresponds to the first antenna 11, and the vertical polarization antenna 40 corresponds to the second antenna 12. In the case of the third antenna set 3, the horizontal polarization antenna 30 corresponds to the fifth antenna 15, and the vertical polarization antenna 40 corresponds to the sixth antenna 16.

The horizontal polarization antenna 30 is a planar antenna having a dielectric substrate 36 famed with antenna conductors 31, 32. The dielectric substrate 36 includes a first substrate surface and a second substrate surface opposite to the first substrate surface. In a case where the horizontal polarization antenna 30 is a microstrip antenna (a patch antenna), a ground conductor (not illustrated) is formed on the second substrate surface so as to be on the opposite side of the dielectric substrate 36 from the antenna conductors 31, 32 and the strip conductor 33 formed on the first substrate surface. The strip conductor 33 is a feeding line of which an end portion is connected to the patch-shaped antenna conductors 31, 32 in parallel. A core conductor 34*a* of a coaxial cable 34 is conductively connected to the strip conductor 33. An outer conductor of the coaxial cable 34 is conductively connected to the ground conductor formed on the second substrate surface. The opposite end, not illustrated, of the coaxial cable 34 is connected to an automotive communication apparatus.

The vertical polarization antenna 40 is a planar antenna including a dielectric substrate 46 famed with antenna conductors 41, 42. The dielectric substrate 46 includes a first substrate surface and a second substrate surface opposite to the first substrate surface. In a case where the vertical polarization antenna 40 is a microstrip antenna (a patch antenna), a ground conductor (not illustrated) is famed on the second substrate surface so as to be on the opposite side of the dielectric substrate 46 from the antenna conductors 41, 42 and a strip conductor 43 formed on the first substrate surface. The strip conductor 43 is a feeding line of which an end portion is connected to the patch-shaped antenna conductors 41, 42 in series. A core conductor 44*a* of a coaxial cable 44 is conductively connected to the strip conductor 43. An outer conductor of the coaxial cable 44 is conductively connected to the ground conductor formed on the second substrate surface. The opposite end, not illustrated, of the coaxial cable 44 is connected to an automotive communication apparatus.

The antenna set as illustrated in FIG. 5 may have a hinge mechanism that allows the dielectric substrates 36, 46 to rotate about a rotation axis 21. The dielectric substrates 36, 46 rotate about the rotation axis 21, so that an angle famed by a direction 35 normal to the dielectric substrate 36 and a direction 45 normal to the dielectric substrate 46 can be adjusted to obtain a desired antenna gain and directivity. The antenna set of FIG. 5 is illustrated such that the substrate surface of the dielectric substrate 36, the antenna surface of the antenna conductors 31, 32, the substrate surface of the dielectric substrate 46, and the antenna surface of the antenna conductors 41, 42 are parallel to the Z axis direction. However, as explained above, the antenna set of FIG. 5 may be arranged on the vehicle 100 with an inclination of a predetermined angle with respect to the Z axis direction, so that the main beam is at the elevation angle $\alpha$ or the elevation angle $\beta$ in a predetermined range.

Figure 6:
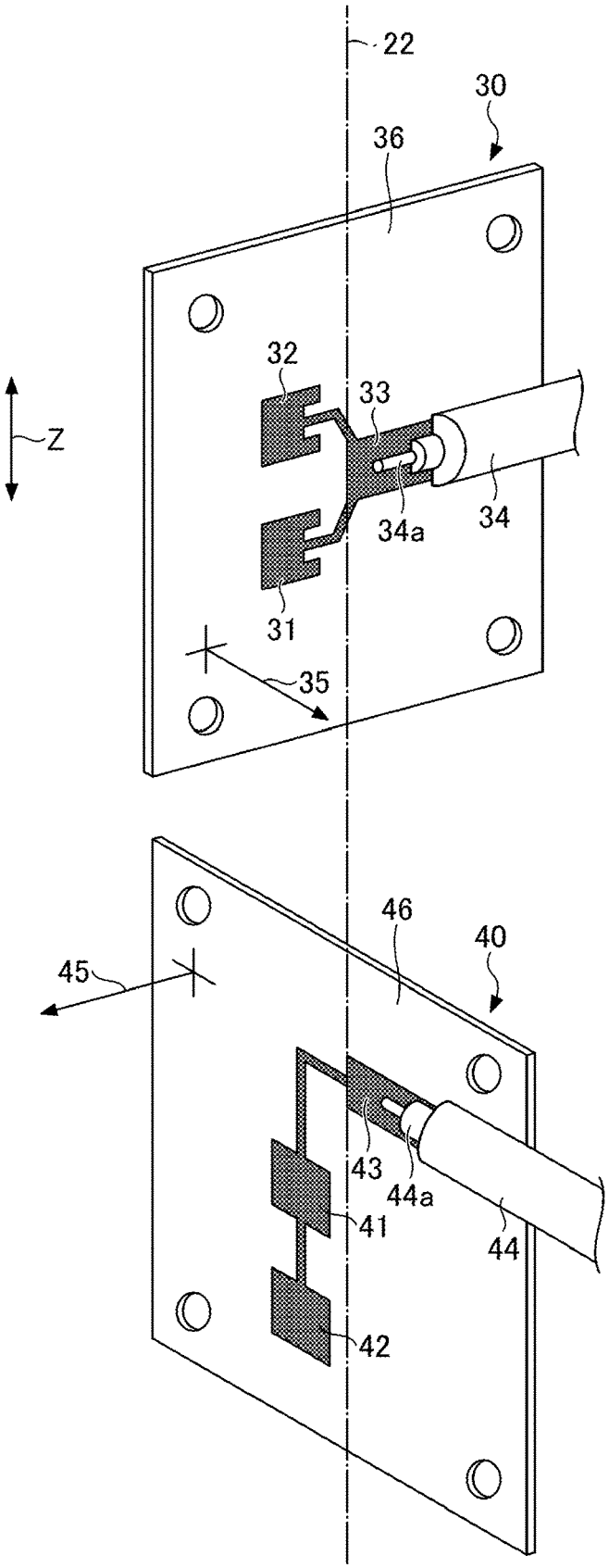
FIG. 6 is a drawing illustrating an example of an antenna set including two antennas arranged in the vertical direction.

FIG. 6 is a drawing illustrating an example of an antenna set including a horizontal polarization antenna 30 and a vertical polarization antenna 40 arranged next to each other in the vertical direction. For example, the antenna set as illustrated in FIG. 6 is an example of the second antenna set 2 and the fourth antenna set 4 explained above. In the case of the second antenna set 2, the horizontal polarization antenna 30 corresponds to the third antenna 13, and the vertical polarization antenna 40 corresponds to the fourth antenna 14. In the case of the fourth antenna set 4, the horizontal polarization antenna 30 corresponds to the seventh antenna 17, and the vertical polarization antenna 40 corresponds to the eighth antenna 18. The configuration of each of the horizontal polarization antenna 30 and the vertical polarization antenna 40 illustrated in FIG. 6 is the same as the above explanation.

The antenna set as illustrated in FIG. 6 may have a mechanism that allows the dielectric substrates 36, 46 to rotate about a rotation axis 22. The dielectric substrates 36, 46 rotate about the rotation axis 22, so that an angle famed by a direction 35 normal to the dielectric substrate 36 and a direction 45 normal to the dielectric substrate 46 can be adjusted to obtain a desired antenna gain and directivity. The antenna set of FIG. 6 is illustrated such that the substrate surface of the dielectric substrate 36, the antenna surface of the antenna conductors 31, 32, the substrate surface of the dielectric substrate 46, and the antenna surface of the antenna conductors 41, 42 are parallel to the Z axis direction. However, as explained above, the antenna set of FIG. 6 may also be arranged on the vehicle 100 with an inclination of a predetermined angle with respect to the Z axis direction, so that the main beam is at the elevation angle $\alpha$ or the elevation angle $\beta$ in a predetermined range.

The vertical polarization antenna or the horizontal polarization antenna is not limited to the microstrip antenna, and may be antennas in other forms. For example, the vertical polarization antenna or the horizontal polarization antenna may be a planar antenna fed by a coplanar waveguide.

Figure 7:
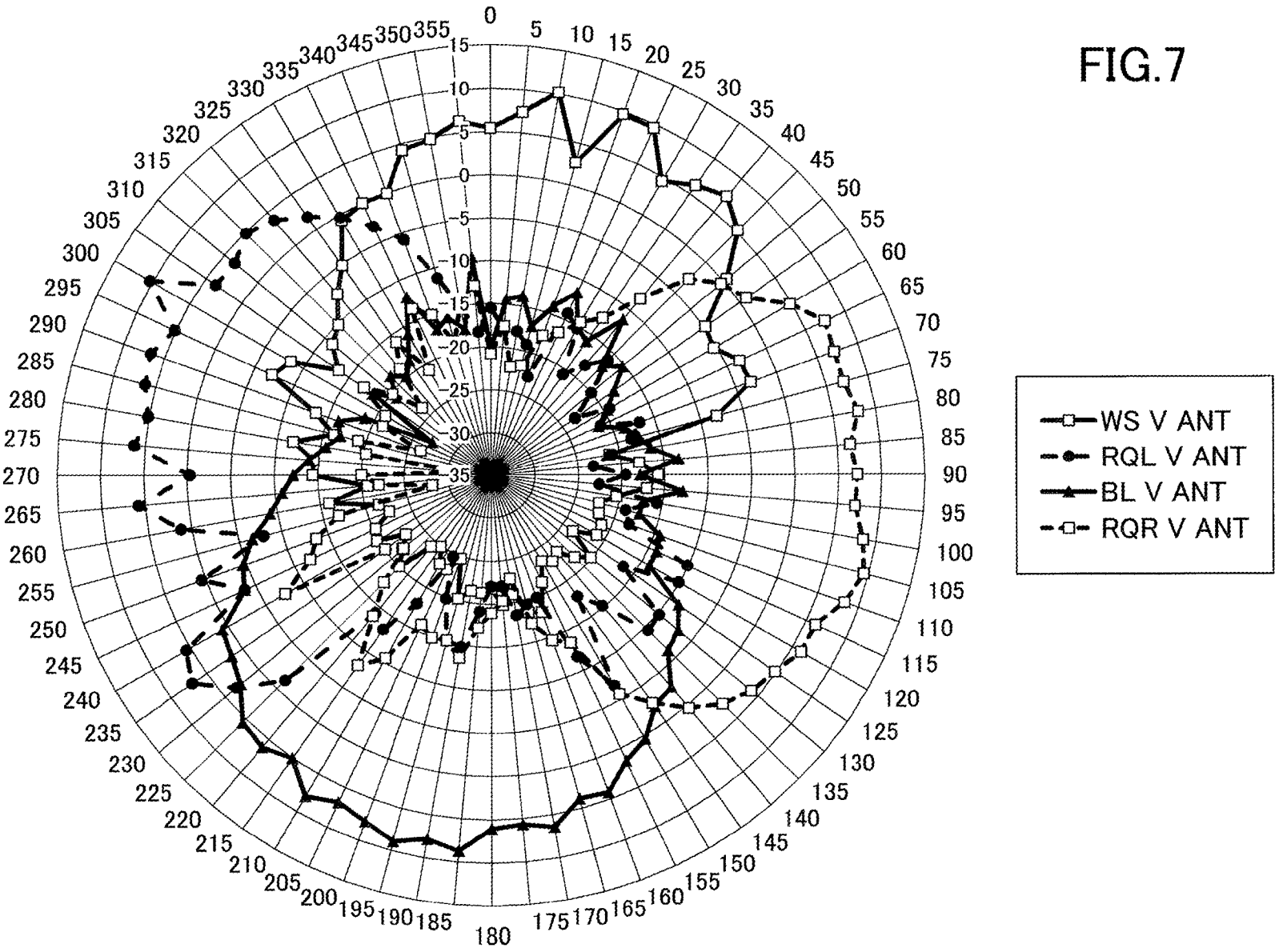
FIG. 7 is a drawing illustrating an example of directivities of multiple vertical polarization antennas.

FIG. 7 is a drawing illustrating examples of directivities of the antennas 12, 14, 16, and 18, i.e., a plurality of vertical polarization antennas. "WS V ANT", "RQL V ANT", "BL V ANT", and "RQR V ANT" as illustrated in FIG. 7 represent examples of measurement results of the antenna gains of the antennas 12, 14, 16, and 18, respectively.

Figure 8:
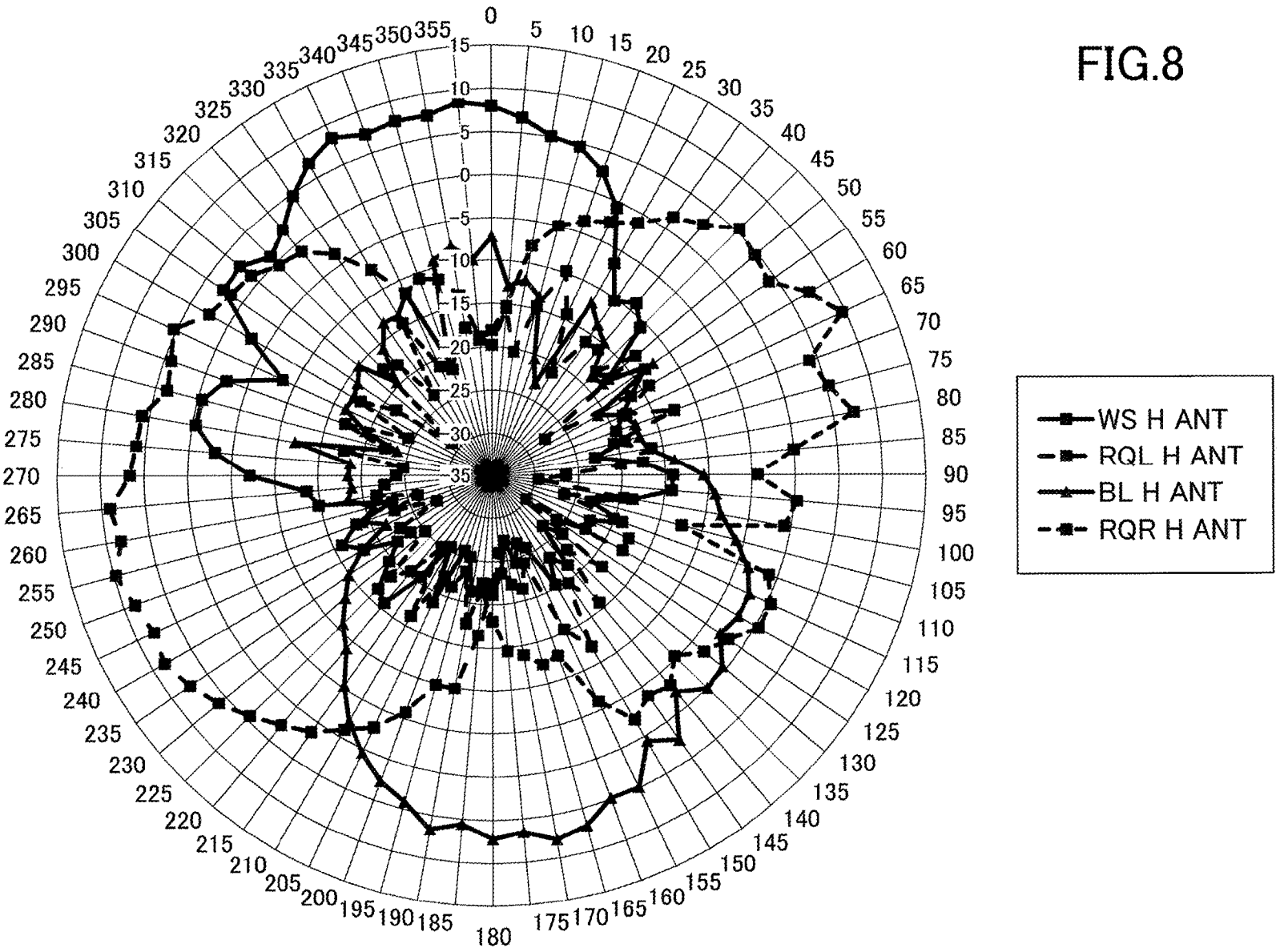
FIG. 8 is a drawing illustrating an example of directivities of multiple horizontal polarization antennas.

FIG. 8 is a drawing illustrating examples of directivities of the antennas 11, 13, 15, and 17, i.e., a plurality of horizontal polarization antennas. "WS H ANT", "RQL H ANT", "BL H ANT", and "RQR H ANT" as illustrated in FIG. 8 represent examples of measurement results of the antenna gains of the antennas 11, 13, 15, and 17, respectively.

Figure 9:
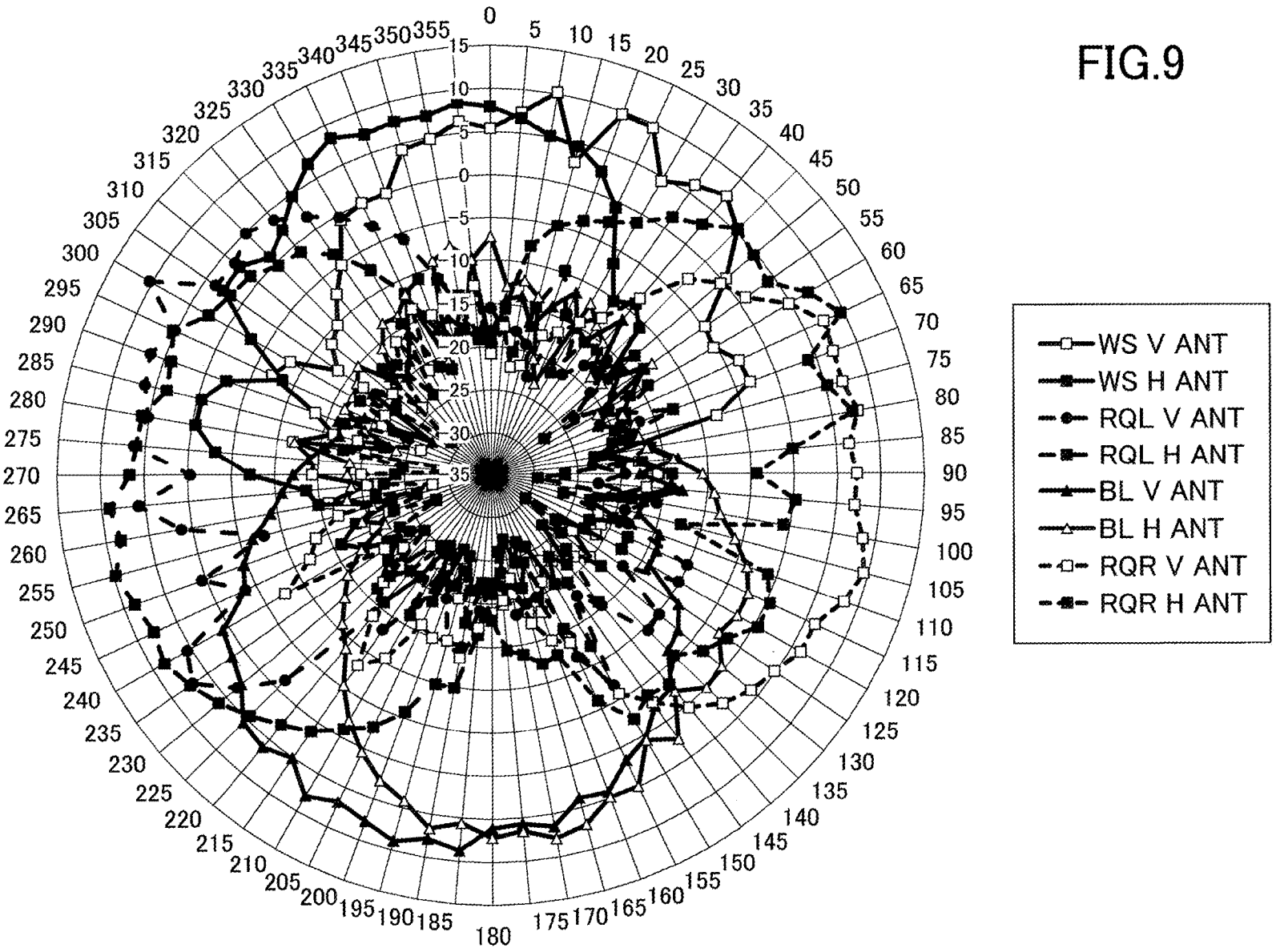
FIG. 9 is a drawing illustrating both of the directivities of FIG. 7 and the directivities of FIG. 8.

FIG. 9 is a drawing illustrating both the directivity of FIG. 7 and the directivity of FIG. 8. As illustrated in FIG. 9, the directivity of the antenna system 101 can be brought closer to the omnidirectional pattern. In this manner, the antenna system 101 capable of achieving both a higher antenna gain and a wider directivity with a lower polarization dependence can be achieved.

The antenna gain was measured by setting the center of the vehicle, to which the antennas were attached as illustrated in FIGS. 1 and 2, at the center of a turn table. Then, the antenna gains of the vertically polarized waves and the horizontally polarized waves transmitted from a transmission antenna fixed at an outer side of the turn table were measured by changing the azimuth in the horizontal plane with respect to the antenna while the elevation angle with respect to the antenna is fixed.

At this occasion, an angle $\gamma_{12}$ (corresponding to the angle $\theta_{12}$), an angle $\gamma_{34}$ (corresponding to the angle $\theta_{34}$), an angle $\gamma_{56}$ (corresponding to the angle $\theta_{56}$, and an angle $\gamma_{78}$ (corresponding to the angle $\theta_{78}$) formed by the two dielectric substrates were set to 135 degrees. The antenna sets were arranged so that the dielectric substrates of the antenna sets were inclined 10 degrees with respect to the Z axis direction and the elevation angle $\alpha$ and the elevation angle $\beta$ were 10 degrees. The fixed transmission antenna was arranged on an extension line of which the elevation angle $\alpha$ was 10 degrees.

In a case where an azimuth $\theta r$ was changed from 0 degrees to 360 degrees in 5-degree increments, the antenna gains of the vertically polarized wave and the horizontally polarized wave measured at 28 GHz were plotted in FIGS. 7 to 9. In other words, although FIGS. 7 to 9 illustrate the antenna gain where the azimuth $\theta r$ was in a range of 0 degrees to 360 degrees, the antenna gain at each azimuth $\theta r$ was the antenna gain where the elevation angle $\alpha$ was 10 degrees, and such antenna gains were illustrated in a planar manner.

Hereinabove, the antenna system for the vehicle has been explained with reference to the embodiment, but the present invention is not limited to the above embodiment. Various modifications and improvements, such as combinations and replacements with a part or all of another embodiment, can be made within the scope of the present invention.

For example, the type of the vehicle 100 illustrated in FIGS. 1 and 2 is a coupe, but the present invention is also applicable to other types of vehicles such as sedans, hatchbacks, vans, buses, and trucks.

For example, the four antenna sets may be arranged on or in proximity to the dielectrics arranged on a front side and a rear side of a vehicle. More specifically, from among the four antenna sets, one or a plurality of antenna sets may be arranged in proximity to the windshield 110 on the front side of the vehicle, and a remaining one or a plurality of antenna sets may be arranged in proximity to the rear glass 130 on the rear side of the vehicle.

For example, from among the antenna sets arranged in proximity to the windshield 110 on the front side of the vehicle, one of the antenna sets may be arranged in proximity to the upper left portion on the inner side, i.e., the passenger compartment side, of the windshield 110, and the other of the antenna sets may be arranged in proximity to the upper right portion on the inner side, i.e., the passenger compartment side, of the windshield 110. From among the antenna sets arranged in proximity to the rear glass 130 on the rear side of the vehicle, one of the antenna sets may be arranged in proximity to the upper right portion on the inner side, i.e., the passenger compartment side, of the rear glass 130, and the other of the antenna sets may be arranged in proximity to the upper left portion on the inner side, i.e., the passenger compartment side, of the rear glass 130.

Alternatively, for example, one antenna set may be arranged in proximity to the upper central portion on the inner side, i.e., the passenger compartment side, of the windshield 110, and the remaining three antenna sets may be arranged in proximity to the upper right portion, the upper central portion, and the upper left portion on the inner side, i.e., the passenger compartment side, of the rear glass 130.

For example, the four antenna sets may be arranged on or in proximity to the dielectric arranged on a right side and a left side of the vehicle. More specifically, from among the four antenna sets, one or a plurality of antenna sets may be arranged in proximity to the right-side window glass of the vehicle, and the remaining one or a plurality of antenna sets may be arranged in proximity to the left-side window glass of the vehicle.

For example, in a vehicle relatively long in the longitudinal direction such as a bus, one antenna set may be arranged on the right front portion, another antenna set may be arranged on the right rear portion, and of the remaining two antenna sets, one may be arranged on the left front portion and the other one may be arranged on the left rear portion.

For example, the two antenna sets may be arranged in proximity to the upper left portion and the upper right portion on the inner side, i.e., the passenger compartment side, of the windshield 110, and the remaining two antenna sets may be arranged in proximity to the inner sides, i.e., the passenger compartment sides, of the right-side fixed window glass 120 and the left-side fixed window glass 140.

The dielectric on the right side of the vehicle is not limited to the right-side fixed window glass 120, and may be window glass on the right side of the vehicle, such as right door glass 150 arranged in the right door, right-side fixed window glass arranged closer to the front than is the right door glass 150, and the like. Likewise, the dielectric on the left side of the vehicle is not limited to the left-side fixed window glass 140, and may be window glass on the left side of the vehicle, such as left door glass 160 arranged in the left door, left-side fixed window glass arranged closer to the front than is the left door glass 160, and the like.

The number of antenna sets is not limited to four, and may be five or more. The number of antennas that a single antenna set includes is not limited to two, and may be three or more.

The antenna sets are not limited to be arranged in proximity to dielectric such as window glass. The antenna sets may be directly arranged by being pasted to or embedded in the dielectric, for example. The dielectric is not limited to the window glass, and may be glass pasted to a pillar, other dielectrics such as resins, and the like, and may be, for example, resin members such as instrument panels, linings, and the like in the passenger compartment.

Figure 10:
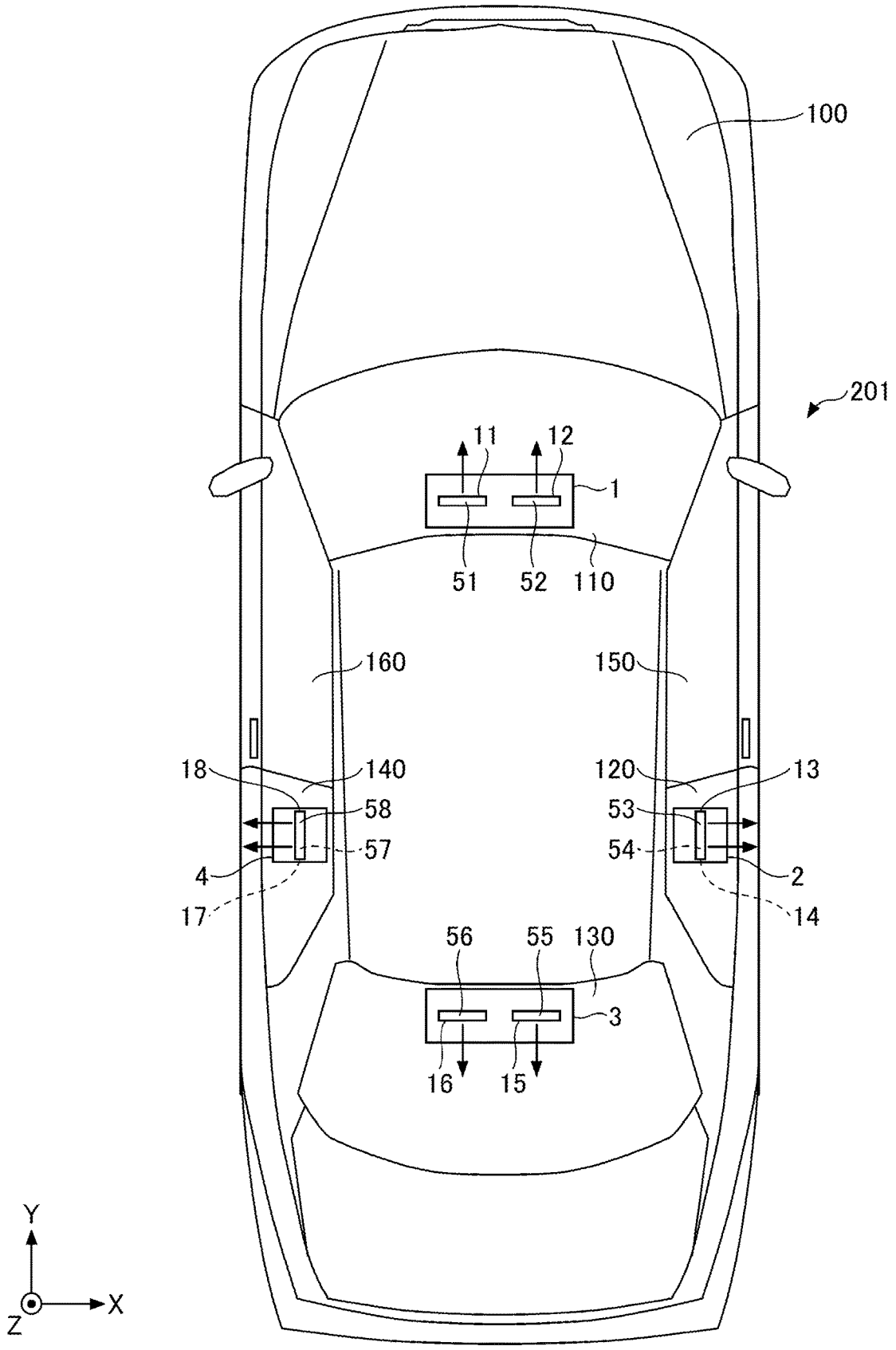
FIG. 10 is a drawing illustrating, in a plan view, an example of a vehicle provided with an antenna system for the vehicle according to another embodiment of the present disclosure.

An example of an antenna system different from the antenna system 101 for the vehicle includes an antenna system 201 as illustrated in FIG. 10. FIG. 10 is a drawing illustrating, in a plan view, an example of a vehicle provided with the antenna system for the vehicle according to another embodiment of the present disclosure. FIG. 10 illustrates an example of a plurality of antenna sets arranged in proximity to window glass arranged on a front side and a rear side of the vehicle 100, or arranged on a right side and a left side of the vehicle 100, or arranged on both of the front side and the rear side of vehicle 100 and the right side and the left side of the vehicle 100. In the explanation about the antenna system 201, with regard to the same configuration as the antenna system 101, the explanation about the antenna system 101 is incorporated herein by reference.

Similarly with the antenna system 101 for the vehicle, the antenna system 201 for the vehicle includes a first antenna set 1 to a fourth antenna set 4, but the two types (i.e., for the horizontally polarized waves and for the vertically polarized waves) of the antennas constituting each antenna set are arranged so that the directions of the main beams of the two types of antennas are in the same direction. In other words, the first antenna 11 and the second antenna 12 constituting the first antenna set 1 are arranged on the substrates in the same plane or in planes parallel to each other. Likewise, the third antenna 13 and the fourth antenna 14 constituting the second antenna set 2 are arranged on the substrates in the same plane or in planes parallel to each other, the fifth antenna 15 and the sixth antenna 16 constituting the third antenna set 3 are arranged on the substrates in the same plane or in planes parallel to each other, and the seventh antenna 17 and the eighth antenna 18 constituting the fourth antenna set 4 are arranged on the substrates in the same plane or in planes parallel to each other.

In the example of the antenna system 201 as illustrated in FIG. 10, at each of the four positions, i.e., in the front direction, the right direction, the rear direction, and the left direction of the vehicle 100, when the vehicle 100 is seen from above, the two types of main beams i.e., the main beam of the horizontally polarized waves and the main beam of the vertically polarized waves, are in the same direction. The antenna system 201 is suitable for a system that is well adapted to transmitting and receiving both polarizations, i.e., the vertically polarized waves and the horizontally polarized waves. The half-power beam angle of each main beam of the antenna system 201 is preferably equal to or more than 60 degrees and equal to or less than 120 degrees in order to achieve a wider directivity, although it depends on the arrangements of the antenna sets. When the half-power beam angle of the main beam is increased, the reception sensitivity tends to decrease, and therefore, the half-power beam angle may be configured according to a predetermined technical specification.

Figure 11:
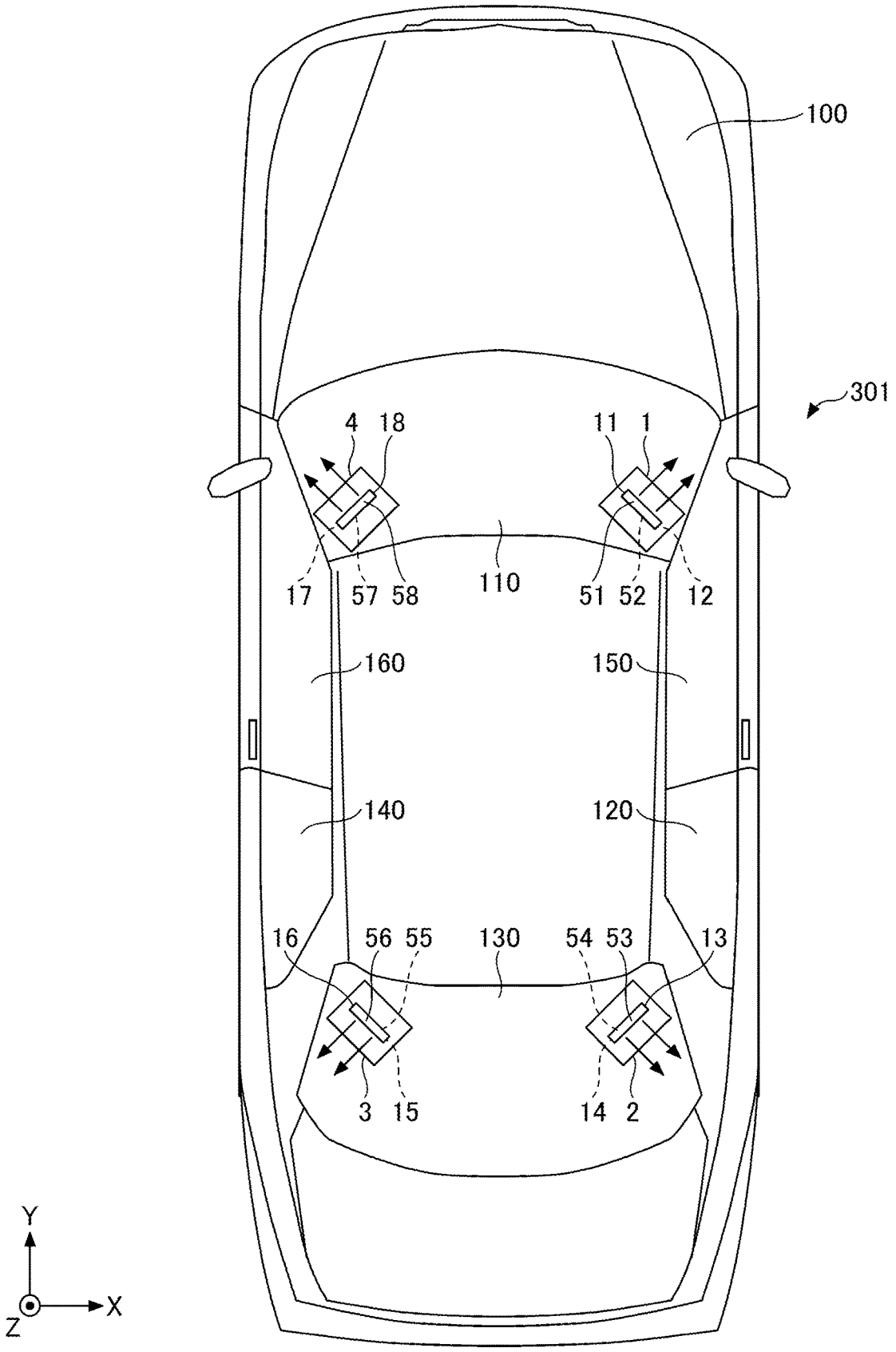
FIG. 11 is a drawing illustrating, in a plan view, an example of a vehicle provided with an antenna system for the vehicle according to another embodiment of the present disclosure.

An example of an antenna system different from the antenna system 201 for the vehicle includes an antenna system 301 as illustrated in FIG. 11. FIG. 11 is a drawing illustrating, in a plan view, an example of a vehicle provided with the antenna system for the vehicle according to another embodiment of the present disclosure. FIG. 11 illustrates an example of a plurality of antenna sets arranged in proximity to the window glass on each of the sides where the azimuth with respect to the forward direction of the vehicle 100 is ±45 degrees and the sides where the azimuth with respect to the rearward direction of the vehicle 100 is ±45 degrees. In the explanation about the antenna system 301, with regard to the same configuration as the antenna system 201, the explanation about the antenna system 201 is incorporated herein by reference.

Similarly with the antenna system 201 for the vehicle, the antenna system 301 for the vehicle includes a first antenna set 1 to a fourth antenna set 4, but the two types (i.e., for the horizontally polarized waves and for the vertically polarized waves) of the antennas constituting each antenna set are arranged so that the directions of the main beams of the two types of antennas are in the same direction. In this case, the half-power beam angle of each main beam of the antenna system 301 is preferably equal to or more than 60 degrees and equal to or less than 120 degrees in order to achieve a wider directivity, although it depends on the arrangements of the antenna sets.

For example, the first antenna set 1 is arranged on or in proximity to the dielectric in the direction of an azimuth angle of +45 degrees with respect to the forward direction of the vehicle 100. In FIG. 11, the first antenna set 1 is arranged on the right side of the windshield 110, but may be arranged on or in proximity to the front portion of the right door glass 150, or may be arranged on or in proximity to right-side fixed window glass closer to the front than is the right door glass 150.

For example, the second antenna set 2 is arranged on or in proximity to the dielectric in the direction of an azimuth angle of +45 degrees with respect to the rearward direction of the vehicle 100. In FIG. 11, the second antenna set 2 is arranged on the right side of the rear glass 130, but may be arranged on or in proximity to the rear portion of the right door glass 150, or may be arranged on or in proximity to the right-side fixed window glass 120 closer to the rear than is the right door glass 150.

For example, the third antenna set 3 is arranged on or in proximity to the dielectric in the direction of an azimuth angle of −45 degrees with respect to the rearward direction of the vehicle 100. In FIG. 11, the third antenna set 3 is arranged on the left side of the rear glass 130, but may be arranged on or in proximity to the rear portion of the left door glass 160, or may be arranged on or in proximity to left-side fixed window glass 140 closer to the rear than is the left door glass 160.

For example, the fourth antenna set 4 is arranged on or in proximity to the dielectric in the direction of an azimuth angle of −45 degrees with respect to the forward direction of the vehicle 100. In FIG. 11, the fourth antenna set 4 is arranged on the left side of the windshield 110, but may be arranged on or in proximity to the front portion of the left door glass 160, or may be arranged on or in proximity to left-side fixed window glass closer to the front than is the left door glass 160.

Similarly with the antenna systems 201, 301 for the vehicle, in a case where the direction of the main beam of the antenna for the horizontally polarized waves and the direction of the main beam of the antenna for the vertically polarized waves in each of the antenna sets are the same, more than four antenna sets may be arranged according to the shape of the vehicle and the desired reception sensitivity.

What is claimed is:

1. An antenna system for a vehicle, comprising:

a plurality of antenna sets provided on or in proximity to a dielectric arranged on a front side and a rear side of the vehicle, or arranged on a right side and a left side of the vehicle, or arranged on both of the front side and the rear side of vehicle and the right side and the left side of the vehicle, wherein a first antenna set included in the plurality of antenna sets includes a first antenna and a second antenna, a second antenna set included in the plurality of antenna sets includes a third antenna and a fourth antenna, a third antenna set included in the plurality of antenna sets includes a fifth antenna and a sixth antenna, a fourth antenna set included in the plurality of antenna sets includes a seventh antenna and an eighth antenna, each of the first antenna, the third antenna, the fifth antenna, and the seventh antenna is a horizontal polarization antenna of which an antenna gain for transmitting and receiving a horizontally polarized wave is higher than an antenna gain for transmitting and receiving a vertically polarized wave, and each of the second antenna, the fourth antenna, the sixth antenna, and the eighth antenna is a vertical polarization antenna of which an antenna gain for transmitting and receiving the vertically polarized wave is higher than an antenna gain for transmitting and receiving the horizontally polarized wave.

2. The antenna system for the vehicle according to claim 1, wherein the first antenna is provided on a first substrate, the second antenna is provided on a second substrate, and a direction normal to the substrate surface of the first substrate and a direction normal to the substrate surface of the second substrate are different from each other, the third antenna is provided on a third substrate, the fourth antenna is provided on a fourth substrate, and a direction normal to the substrate surface of the third substrate and a direction normal to the substrate surface of the fourth substrate are different from each other, the fifth antenna is provided on a fifth substrate, the sixth antenna is provided on a sixth substrate, and a direction normal to the substrate surface of the fifth substrate and a direction normal to the substrate surface of the sixth substrate are different from each other, and the seventh antenna is provided on a seventh substrate, the eighth antenna is provided on an eighth substrate, and a direction normal to the substrate surface of the seventh substrate and a direction normal to the substrate surface of the eighth substrate are different from each other.

3. The antenna system for the vehicle according to claim 2, wherein an angle formed by the substrate surface of the first substrate and the substrate surface of the second substrate is equal to or more than 90 degrees and is less than 180 degrees, an angle famed by the substrate surface of the third substrate and the substrate surface of the fourth substrate is equal to or more than 90 degrees and is less than 180 degrees, an angle famed by the substrate surface of the fifth substrate and the substrate surface of the sixth substrate is equal to or more than 90 degrees and is less than 180 degrees, and an angle formed by the substrate surface of the seventh substrate and the substrate surface of the eighth substrate is equal to or more than 90 degrees and is less than 180 degrees.

4. The antenna system for the vehicle according to claim 2, wherein the first substrate, the second substrate, the third substrate, the fourth substrate, the fifth substrate, the sixth substrate, the seventh substrate, and the eighth substrate are arranged so that the direction normal to the substrate surface of the first substrate, the direction normal to the substrate surface of the second substrate, the direction normal to the substrate surface of the third substrate, the direction normal to the substrate surface of the fourth substrate, the direction normal to the substrate surface of the fifth substrate, the direction normal to the substrate surface of the sixth substrate, the direction normal to the substrate surface of the seventh substrate, and the direction normal to the substrate surface of the eighth substrate are different from one another.

5. The antenna system for the vehicle according to claim 2, wherein the first substrate, the second substrate, the third substrate, the fourth substrate, the fifth substrate, the sixth substrate, the seventh substrate, and the eighth substrate are arranged so that an elevation angle in the direction normal to the substrate surface of the first substrate, an elevation angle in the direction normal to the substrate surface of the second substrate, an elevation angle in the direction normal to the substrate surface of the third substrate, an elevation angle in the direction normal to the substrate surface of the fourth substrate, an elevation angle in the direction normal to the substrate surface of the fifth substrate, an elevation angle in the direction normal to the substrate surface of the sixth substrate, an elevation angle in the direction normal to the substrate surface of the seventh substrate, and an elevation angle in the direction normal to the substrate surface of the eighth substrate are equal to or more than 0 degrees and are equal to or less than 60 degrees.

6. The antenna system for the vehicle according to claim 2, wherein the first antenna set is arranged on or in proximity to the dielectric arranged on the front side of the vehicle, and the first substrate and the second substrate are arranged next to each other in a horizontal direction so as to face an area in front of the vehicle, and the third antenna set is arranged on or in proximity to the dielectric arranged on the rear side of the vehicle, and the fifth substrate and the sixth substrate are arranged next to each other in the horizontal direction so as to face an area behind the vehicle.

7. The antenna system for the vehicle according to claim 2, wherein the second antenna set is arranged on or in proximity to the dielectric arranged on the right side of the vehicle, and the third substrate and the fourth substrate are arranged next to each other in a direction perpendicular to a horizontal plane so as to face an area to the right of the vehicle, and the fourth antenna set is arranged on or in proximity to the dielectric arranged on the left side of the vehicle, and the seventh substrate and the eighth substrate are arranged next to each other in the direction perpendicular to the horizontal plane so as to face an area to the left of the vehicle.

8. The antenna system for the vehicle according to claim 1, wherein the first antenna and the second antenna are arranged so that a direction of a main beam of the first antenna and a direction of a main beam of the second antenna are different from each other, the third antenna and the fourth antenna are arranged so that a direction of a main beam of the third antenna and a direction of a main beam of the fourth antenna are different from each other, the fifth antenna and the sixth antenna are arranged so that a direction of a main beam of the fifth antenna and a direction of a main beam of the sixth antenna are different from each other, and the seventh antenna and the eighth antenna are arranged so that a direction of a main beam of the seventh antenna and a direction of a main beam of the eighth antenna are different from each other.

9. The antenna system for the vehicle according to claim 8, wherein an angle formed by the direction of the main beam of the first antenna and the direction of the main beam of the second antenna is equal to or more than 90 degrees and is less than 180 degrees, an angle famed by the direction of the main beam of the third antenna and the direction of the main beam of the fourth antenna is equal to or more than 90 degrees and is less than 180 degrees, an angle famed by the direction of the main beam of the fifth antenna and the direction of the main beam of the sixth antenna is equal to or more than 90 degrees and is less than 180 degrees, and an angle famed by the direction of the main beam of the seventh antenna and the direction of the main beam of the eighth antenna is equal to or more than 90 degrees and is less than 180 degrees.

10. The antenna system for the vehicle according to claim 8, wherein the first antenna, the second antenna, the third antenna, the fourth antenna, the fifth antenna, the sixth antenna, the seventh antenna, and the eighth antenna are arranged so that the direction of the main beam of the first antenna, the direction of the main beam of the second antenna, the direction of the main beam of the third antenna, the direction of the main beam of the fourth antenna, the direction of the main beam of the fifth antenna, the direction of the main beam of the sixth antenna, the direction of the main beam of the seventh antenna, and the direction of the main beam of the eighth antenna are different from one another.

11. The antenna system for the vehicle according to claim 8, wherein the first antenna, the second antenna, the third antenna, the fourth antenna, the fifth antenna, the sixth antenna, the seventh antenna, and the eighth antenna are arranged so that an elevation angle of the direction of the main beam of the first antenna, an elevation angle of the direction of the main beam of the second antenna, an elevation angle of the direction of the main beam of the third antenna, an elevation angle of the direction of the main beam of the fourth antenna, an elevation angle of the direction of the main beam of the fifth antenna, an elevation angle of the direction of the main beam of the sixth antenna, an elevation angle of the direction of the main beam of the seventh antenna, and an elevation angle of the direction of the main beam of the eighth antenna are equal to or more than 0 degrees and are equal to or less than 60 degrees.

12. The antenna system for the vehicle according to claim 8, wherein the first antenna set is arranged on or in proximity to the dielectric arranged on the front side of the vehicle, and the first antenna and the second antenna are arranged next to each other in a horizontal direction so that the direction of the main beam of the first antenna and the direction of the main beam of the second antenna extend toward an area in front of the vehicle, and the third antenna set is arranged on or in proximity to the dielectric arranged on the rear side of the vehicle, and the fifth antenna and the sixth antenna are arranged next to each other in a horizontal direction so that the direction of the main beam of the fifth antenna and the direction of the main beam of the sixth antenna extend toward an area behind the vehicle.

13. The antenna system for the vehicle according to claim 8, wherein the second antenna set is arranged on or in proximity to the dielectric arranged on the right side of the vehicle, and the third antenna and the fourth antenna are arranged next to each other in a direction perpendicular to a horizontal plane so that the direction of the main beam of the third antenna and the direction of the main beam of the fourth antenna extend toward an area to the right of the vehicle, and the fourth antenna set is arranged on or in proximity to the dielectric arranged on the left side of the vehicle, and the seventh antenna and the eighth antenna are arranged next to each other in the direction perpendicular to the horizontal plane so that the direction of the main beam of the seventh antenna and the direction of the main beam of the eighth antenna extend toward an area to the left of the vehicle.

14. The antenna system for the vehicle according to claim 1, wherein the first antenna, the second antenna, the third antenna, the fourth antenna, the fifth antenna, the sixth antenna, the seventh antenna, and the eighth antenna are arranged so that the direction of the main beam of the horizontal polarization antenna and the direction of the main beam of the vertical polarization antenna are alternately arranged in a clockwise direction when the vehicle is seen from above.

15. The antenna system for the vehicle according to claim 1, wherein an antenna gain of the main beam of each of the first antenna, the second antenna, the third antenna, the fourth antenna, the fifth antenna, the sixth antenna, the seventh antenna, and the eighth antenna is equal to or more than 4 dBi and is equal to or less than 11 dBi.

16. The antenna system for the vehicle according to claim 1, wherein the first antenna is provided on a first substrate, the second antenna is provided on a second substrate, and a direction normal to the substrate surface of the first substrate and a direction normal to the substrate surface of the second substrate are the same as each other, the third antenna is provided on a third substrate, the fourth antenna is provided on a fourth substrate, and a direction normal to the substrate surface of the third substrate and a direction normal to the substrate surface of the fourth substrate are the same as each other, the fifth antenna is provided on a fifth substrate, the sixth antenna is provided on a sixth substrate, and a direction normal to the substrate surface of the fifth substrate and a direction normal to the substrate surface of the sixth substrate are the same as each other, and the seventh antenna is provided on a seventh substrate, the eighth antenna is provided on an eighth substrate, and a direction normal to the substrate surface of the seventh substrate and a direction normal to the substrate surface of the eighth substrate are the same as each other.

17. The antenna system for the vehicle according to claim 1, wherein the first antenna set is arranged on or in proximity to the dielectric arranged on the front side of the vehicle, the second antenna set is arranged on or in proximity to the dielectric arranged on the right side of the vehicle, the third antenna set is arranged on or in proximity to the dielectric arranged on the rear side of the vehicle, and the fourth antenna set is arranged on or in proximity to the dielectric arranged on the left side of the vehicle.

18. The antenna system for the vehicle according to claim 1, wherein where a wavelength of an electromagnetic wave to be transmitted and received is denoted as $\lambda$, a distance between any given two of the first antenna, the third antenna, the fifth antenna, and the seventh antenna is equal to or more than $10\lambda$, and a distance between any given two of the second antenna, the fourth antenna, the sixth antenna, and the eighth antenna is equal to or more than $10\lambda$.

19. The antenna system for the vehicle according to claim 1, wherein the dielectric is glass or resin.

20. The antenna system for the vehicle according to claim 1, wherein the first antenna set, the second antenna set, the third antenna set, and the fourth antenna set transmit and receive an electromagnetic wave at a frequency of 3 GHz or more and 100 GHz or less.

* * * * *